US007297076B2

(12) United States Patent
Pohrer

(10) Patent No.: US 7,297,076 B2
(45) Date of Patent: Nov. 20, 2007

(54) METHOD AND APPARATUS FOR RETRACTABLE ENCLOSURE

(75) Inventor: Christopher M. Pohrer, St. Louis, MO (US)

(73) Assignee: Aalco Manufacturing Company, St. Louis, MO (US)

( * ) Notice: Subject to any disclaimer, the term of this patent is extended or adjusted under 35 U.S.C. 154(b) by 0 days.

(21) Appl. No.: 10/704,476

(22) Filed: Nov. 7, 2003

(65) Prior Publication Data

US 2005/0101419 A1 May 12, 2005

(51) Int. Cl.
*A63B 67/00* (2006.01)

(52) U.S. Cl. ..... 473/421; 473/415; 473/465

(58) Field of Classification Search ..... 473/415, 473/422, 421, 465, 490, 197, 162, 172; 52/6, 52/10, 122.1; 135/139, 134, 126–128; 296/112, 296/100.1, 100.11, 100.18; 160/248, 241, 160/243, 330, 331, 123
See application file for complete search history.

(56) References Cited

U.S. PATENT DOCUMENTS

| | | | | | |
|---|---|---|---|---|---|
| 914,180 | A * | 3/1909 | Patterson | 160/244 |
| 1,591,753 | A * | 7/1926 | Flaugh | 473/421 |
| 2,486,170 | A * | 10/1949 | Kavanaugh | 135/131 |
| 2,923,547 | A * | 2/1960 | Heeremans | 473/421 |
| 3,222,067 | A * | 12/1965 | Litwhiler et al. | 473/421 |
| 3,429,298 | A * | 2/1969 | Thomason | 119/448 |
| 3,593,997 | A * | 7/1971 | Boehner | 473/421 |
| 3,980,304 | A | 9/1976 | O'Neill et al. | |
| 4,153,246 | A * | 5/1979 | Byrne | 473/197 |
| 4,180,352 | A * | 12/1979 | Divers et al. | 405/303 |
| 4,192,503 | A * | 3/1980 | Karas | 473/459 |
| 4,324,386 | A * | 4/1982 | Gagnon et al. | 254/288 |
| 4,815,736 | A * | 3/1989 | Wright | 473/421 |
| 4,844,109 | A * | 7/1989 | Navarro | 135/129 |
| 4,991,901 | A * | 2/1991 | Meekhof et al. | 296/98 |
| 5,007,645 | A * | 4/1991 | Weigl et al. | 473/197 |
| 5,116,056 | A * | 5/1992 | Schmutte | 473/172 |
| 5,205,564 | A * | 4/1993 | Lamberti et al. | 273/400 |
| 5,409,230 | A * | 4/1995 | Dunaway et al. | 473/161 |
| 5,634,638 | A * | 6/1997 | Havens et al. | 473/421 |
| 5,655,766 | A * | 8/1997 | Klebe, Jr. | 473/421 |
| 6,112,797 | A * | 9/2000 | Colson et al. | 160/121.1 |
| 6,223,479 | B1 * | 5/2001 | Stockli | 52/68 |
| D456,196 | S * | 4/2002 | Colson et al. | D6/575 |
| 6,800,043 | B1 * | 10/2004 | Pohrer | 473/493 |
| 2002/0157796 | A1 * | 10/2002 | Judkins | 160/84.04 |

* cited by examiner

*Primary Examiner*—Mitra Aryanpour
(74) *Attorney, Agent, or Firm*—Armstrong Teasdale LLP

(57) ABSTRACT

A method for assembling a sports enclosure includes coupling a driving gear to an upper support structure, coupling a net having an upper edge and a lower edge to the upper support structure such that an enclosure is at least partially defined by the net, and coupling the lower edge of the net to the driving gear such that operation of the driving gear raises the net such that the net is folded in an accordion like manner between the upper support structure and the lower edge of the net.

14 Claims, 5 Drawing Sheets

METHOD AND APPARATUS FOR RETRACTABLE ENCLOSURE

BACKGROUND OF THE INVENTION

This invention relates generally to an enclosure and more particularly, to a retractable sports enclosure.

Various sports, including baseball, softball, and golf, for example, are played on relatively large outdoor fields. The playing fields may be utilized by several different groups of athletes for practice and/or actual games. And as such, the availability of playing fields may be limited by game and/or practice schedules. Furthermore, inclement weather may limit the use of outdoor playing fields.

Accordingly, outdoor sports teams may practice in indoor facilities. Within such facilities, netted enclosures may be used to contain the balls to prevent danger to other persons, damage to property, and/or losing balls during practice sessions. Such enclosures are generally sized large enough to allow a person or persons to practice, while still being portable to facilitate the enclosure structure being moved from one practice location to another, or to a storage location.

For example, at least one known sports enclosure utilizes a plurality of folded frame sections. To expand the enclosure, a net is attached to the support frame and is lowered over the assembled frame using a rope. To retract the enclosure, the net is either folded over the top of the support frame prior to the frame being moved, or is removed from the frame to enable modular frame sections to be collapsed and folded.

At least one other known sports enclosures utilizes a net permanently attached to a plurality of frame sections. The sports enclosure is not expanded or retracted, but rather, the entire enclosure is lowered onto a floor surface when utilized by athletes for practice, and then raised overhead and remains suspended within the sports facility until the enclosure is again required for practice. Accordingly, assembling and retracting such enclosures may be a time consuming and burdensome task that may require the cooperative effort of several people.

BRIEF DESCRIPTION OF THE INVENTION

In one aspect, a method for assembling a sports enclosure is provided. The method includes coupling a driving gear to an upper support structure, coupling a net having an upper edge and a lower edge to the upper support structure such that an enclosure is at least partially defined by the net, and coupling the lower edge of the net to the driving gear such that operation of the driving gear raises the net such that the net is folded in an accordion like manner between the upper support structure and the lower edge of the net.

In another aspect, a method for operating a sports enclosure is provided. The method includes activating a driving gear to selectively raise a net including a net lower edge such that the net is folded in an accordion like manner between the upper support structure and the net lower edge.

In a further aspect, a sports enclosure assembly is provided. The assembly includes an upper support structure, a driving gear coupled to the upper support structure, and a net comprising a lower edge, the net coupled to the upper support structure such that an enclosure is at least partially defined by the net, the net lower edge coupled to the driving gear such that operation of the driving gear raises the net lower edge such that the net is folded between the upper support structure and the net lower edge.

DETAILED DESCRIPTION OF THE INVENTION

Figure 1:
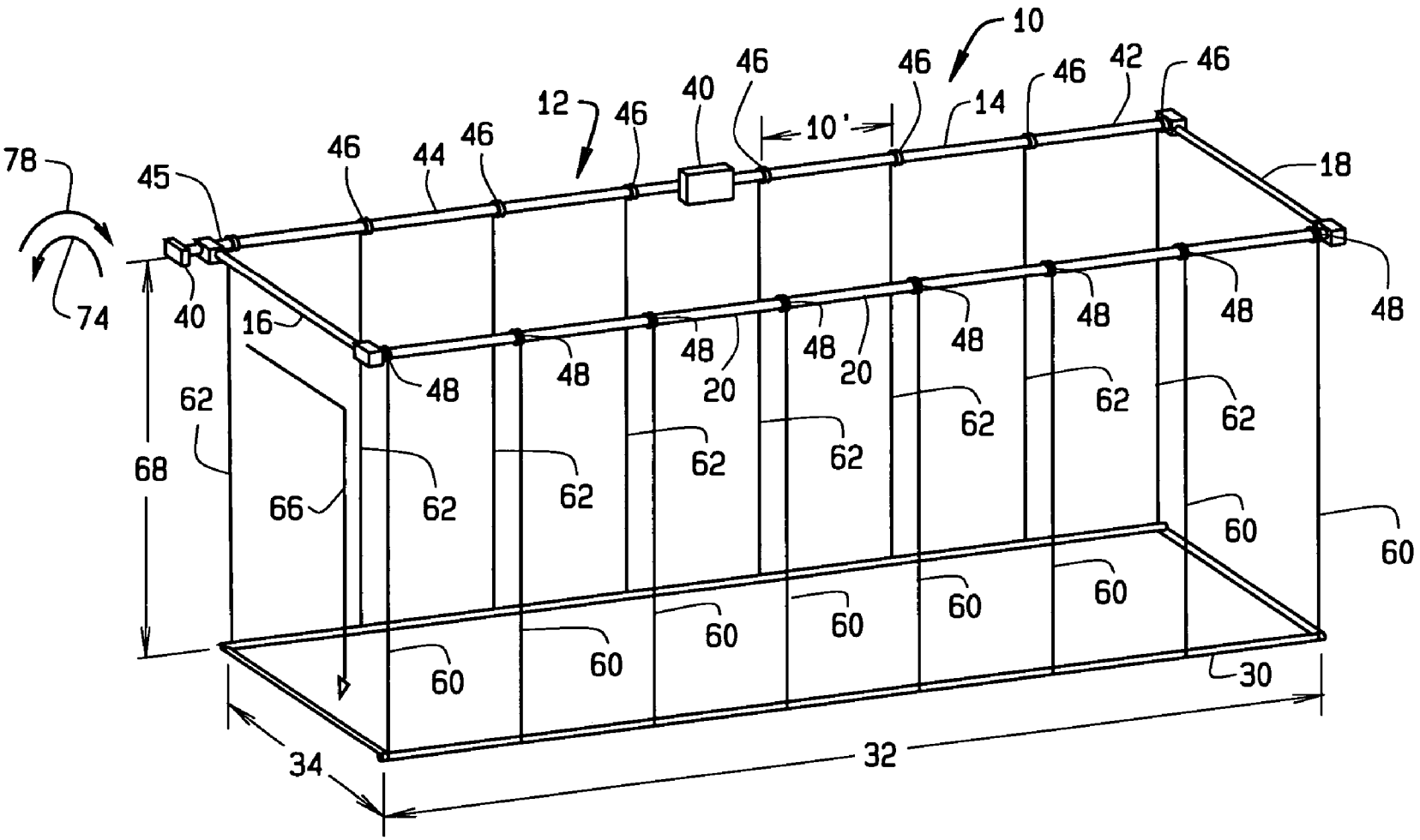
FIG. 1 is a perspective view of an exemplary enclosure assembly.
Figure 2:
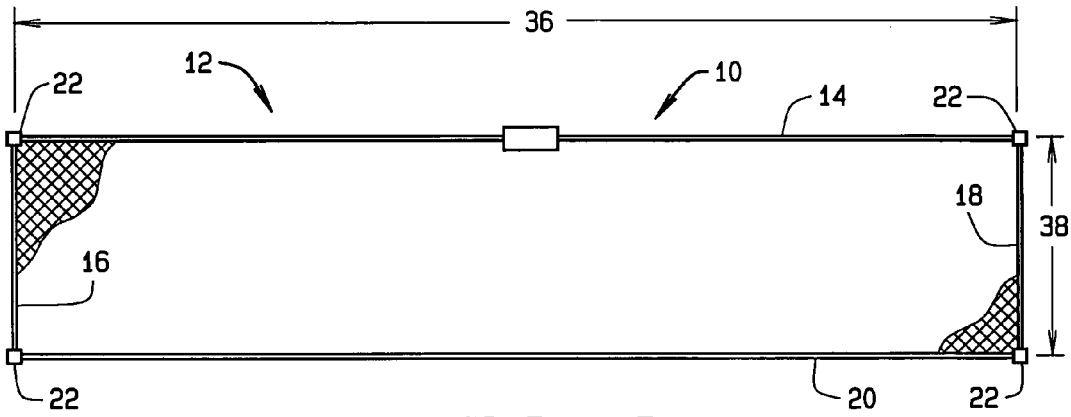
FIG. 2 is a top view of the enclosure assembly shown in FIG. 1.
Figure 3:
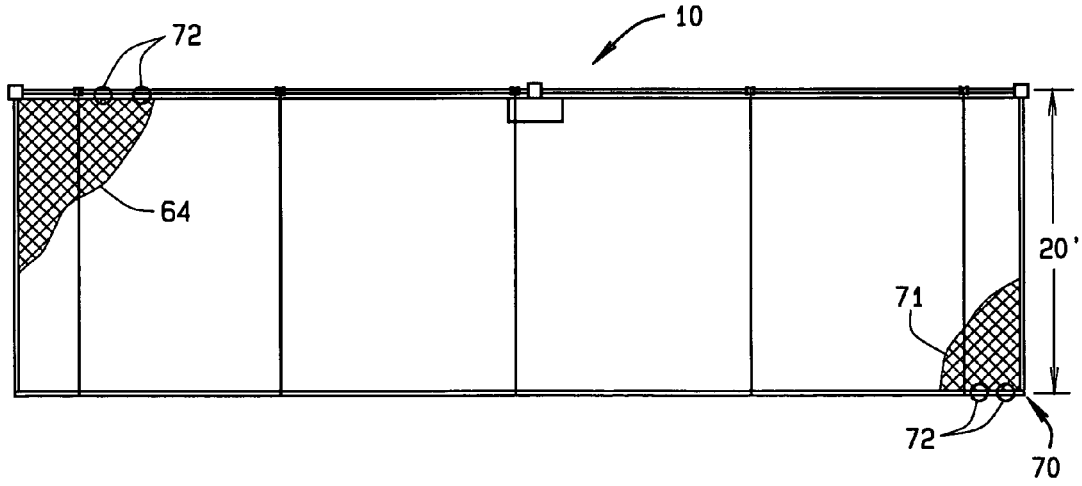
FIG. 3 is a side view of the enclosure assembly shown in FIG. 1.
Figure 4:
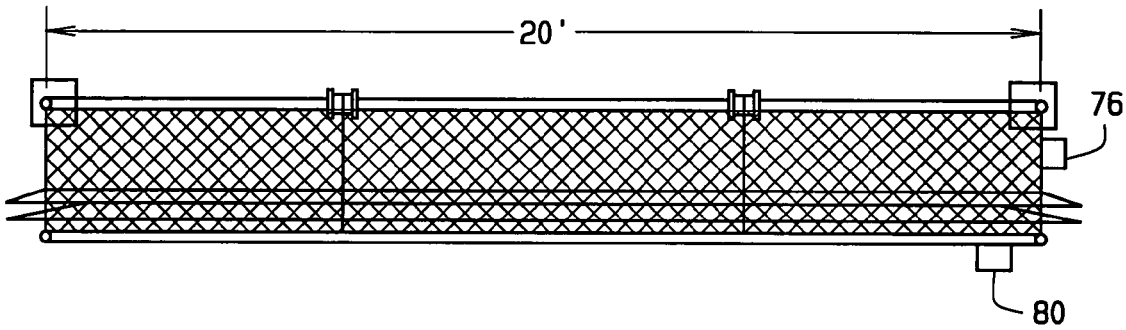
FIG. 4 is a side view of the enclosure assembly shown in FIG. 1 in a partially collapsed configuration.

FIG. 1 is a perspective view of an exemplary enclosure assembly 10. FIG. 2 is a top view of enclosure assembly 10. FIG. 3 is a side view of enclosure assembly 10 in an open configuration. FIG. 4 is a side view of enclosure assembly 10 in a partially collapsed configuration.

In the exemplary embodiment, enclosure assembly 10 includes an upper support structure 12 including a primary drive shaft 14, a first coupling shaft 16, a second coupling shaft 18, and a secondary drive shaft 20. Drive shaft 14 is rotatably coupled to secondary drive shaft 20 through shafts 16 and 18. In the exemplary embodiment, shafts 14, 16, 18, and 20 are coupled together to form a substantially rectangular assembly. More specifically, upper support structure 12 also includes a plurality of dual output gear drives 22 that couple drive shaft 14 to shafts 16 and 18, and couple shafts 16 and 18 to secondary drive shaft 20. In one embodiment, gear drives 22 are beveled gear drives that couple drive shaft 14 to shafts 16 and 18, such that shafts 16 and 18 are substantially perpendicular to shafts 14 and 20. In another embodiment, at least one of gear drives 22 is a beveled gear drive that includes a triple output to drive at least three separate drive shafts.

In the exemplary embodiment, enclosure assembly 10 also includes a lower support structure 30. Lower support structure 30 has a length 32 and a width 34 that are approximately equal to a respective length 36 and width 38 of upper support structure 12. In one embodiment, length 32 and length 36 are each approximately seventy feet, and width 34 and width 38 are each approximately fifteen feet. It should be realized that the size of enclosure assembly 10 is varied depending upon the application of assembly 10, and as such, the size of assembly 10 can be modified without affecting the novelty of the invention described herein. Upper support structure 12 and lower support structure 30 are fabricated from a material such as, but not limited to, an aluminum alloy or steel.

Enclosure assembly 10 also includes at least one gearbox 40 that is coupled to drive shaft 14. In one embodiment, gearbox 40 is a motor driven gearbox. In another embodiment, gearbox 40 is a manually driven gearbox. In one embodiment, gearbox 40 is coupled between a driveshaft first portion 42 and a driveshaft second portion 44. In another embodiment, drive shaft 14 is unitary and gearbox 40 is coupled to an end 45 of drive shaft 14.

Enclosure assembly 10 also includes a plurality of grooved winch drums 46 coupled to drive shaft 14, and a plurality of grooved winch drums 48 that are coupled to secondary drive shaft 20. More specifically, a plurality of first cables 60 and a plurality of second cables 62 are coupled to grooved winch drums 46. In the exemplary embodiment, cables 60 extend through grooved winch drums 48, and are coupled to lower support structure 30. In an alternative embodiment, assembly 10 does not include lower support structure 30, and rather cables 60 are coupled to a net 64. Cables 62 are coupled to grooved winch drums 46 and to either lower support structure 30 or net 64. In the exemplary embodiment, a length 66 of cables 60 is longer than a length 68 of cables 62. In the exemplary embodiment, cables 60 and 62 are interwoven through net 64 and then coupled to lower support structure 30. In another exemplary embodiment, cables 60 and 62 are interwoven through net 64 and then coupled to a lower portion 70 or lower edge 71 of net 64. Plurality of cables 60 and 62 are each fabricated from a material such as, but not limited to, a metallic material and a fibrous material.

Net 64 is coupled to upper support structure 12 and lower support structure 30 using a plurality of fasteners 72. Fasteners 72 may be, but are not limited to being, jack chains. In the exemplary embodiment, fasteners 72 are spaced along upper support structure 12 and lower support structure 30 to secure net 64 to upper support structure 12 and lower support structure 30.

In operation, gearbox 40 is selectively activated, thereby rotating drive shaft 14. Rotational force generated by drive shaft 14 is transmitted from drive shaft 14 to shafts 16 and 18 through gearboxes 22. Rotational forces of shafts 16 and 18 are then transmitted via gearboxes 22 to secondary drive shaft 20. Rotational forces from shafts 14 and 20 cause grooved winch drums 46 and grooved winch drums 48 to rotate in a first direction 74. In an alternative embodiment, shafts 14 and 20 rotate in opposite directions.

As grooved winch drums 46 rotate, cables 60 and cables 62 are wound around grooved winch drums 46 thereby elevating lower support structure 30 and net lower edge 71 towards upper support structure 12. As net lower edge 71 and lower support structure 30 transition towards upper support structure 12, net 64 is folded in an accordion like manner. In the exemplary embodiment, gearbox 40 remains activated until lower support structure 30 contacts a switch 76, i.e. when lower support structure 30 is proximate to and approximately parallel with upper support structure 12 as shown in FIG. 4. In an alternative embodiment, gearbox 40 remains activated until a user selectively de-energizes power to gearbox 40.

To lower sports enclosure 10, gearbox 40 is energized to cause either of grooved winch drums 46 and grooved winch drums 48 rotate in a second direction 78 that is opposite first direction 74. Cables 60 and cable 62 are wound around grooved winch drums 46 causing lower support structure 30 to transition away from upper support structure 12. As lower support structure 30 and upper support structure 12 are separated, net 64 is unfolded until net 64 is suspended substantially unfolded between upper and lower support structures 12 and 30, respectively. In the exemplary embodiment, gearbox 40 remains activated until a switch 80 is activated, i.e. when lower support structure 30 is proximate to and approximately parallel to a floor surface.

Figure 5:
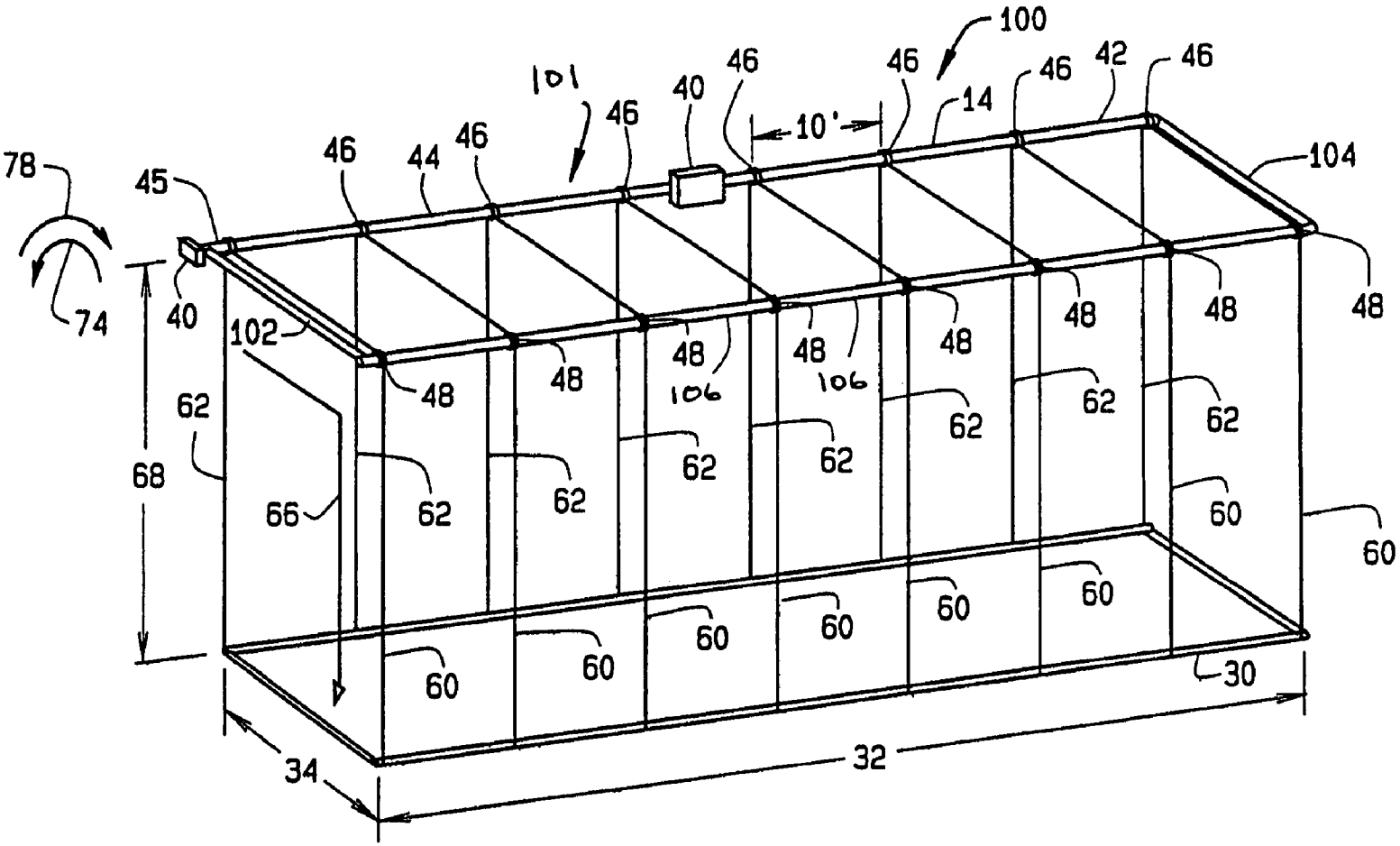
FIG. 5 is a perspective view of an exemplary enclosure assembly.

FIG. 5 is a perspective view of an exemplary enclosure assembly 100. Enclosure assembly 100 is substantially similar to enclosure assembly 10, (shown in FIGS. 1-4) and components in enclosure system 100 that are identical to components of enclosure system 10 are identified in FIG. 5 using the same reference numerals used in FIGS. 1-4.

In the exemplary embodiment, enclosure assembly 100 includes an upper support structure 101 including a primary drive shaft 14, a first coupling shaft 102, a second coupling shaft 104 and a third coupling shaft 106. In the exemplary embodiment, shafts 14, 102, 104, and 106 are coupled together to form a substantially rectangular assembly.

In the exemplary embodiment, enclosure assembly 100 also includes a lower support structure 30. Lower support structure 30 has a length 32 and a width 34 that are approximately equal to a respective length 36 and width 38 of upper support structure 12. In one embodiment, length 32 and length 36 are each approximately seventy feet, and width 34 and width 38 are each approximately fifteen feet. It should be realized that the size of enclosure assembly 100 is varied depending upon the application of assembly 100, and as such, the size of assembly 100 can be modified without affecting the novelty of the invention described herein. Upper support structure 12 and lower support structure 30 are fabricated from a material such as, but not limited to, an aluminum alloy or steel.

Enclosure assembly 100 also includes at least one gearbox 40 that is coupled to drive shaft 14. In one embodiment, gearbox 40 is a motor driven gearbox. In another embodiment, gearbox 40 is a manually driven gearbox. In one embodiment, gearbox 40 is coupled between a driveshaft first portion 42 and a driveshaft second portion 44. In another embodiment, drive shaft 14 is unitary and gearbox 40 is coupled to an end 45 of drive shaft 14.

Enclosure assembly 100 also includes a plurality of grooved winch drums 46 coupled to drive shaft 14, and a plurality of grooved winch drums 48 that are coupled to rotably coupled to third coupling shaft 106. More specifically, a plurality of first cables 60 and a plurality of second cables 62 are coupled to grooved winch drums 46. In the exemplary embodiment, cables 60 extend through grooved winch drums 48, and are coupled to lower support structure 30. In an alternative embodiment, assembly 100 does not include lower support structure 30, and rather cables 60 are coupled to a net 64. Cables 62 are coupled to grooved winch drums 46 and to either lower support structure 30 or net 64. In the exemplary embodiment, a length 66 of cables 60 is longer than a length 68 of cables 62. In the exemplary embodiment, cables 60 and 62 are interwoven through net 64 and then coupled to lower support structure 30. In another exemplary embodiment, cables 60 and 62 are interwoven through net 64 and then coupled to a lower portion 70 or lower edge 71 of net 64. Plurality of cables 60 and 62 are each fabricated from a material such as, but not limited to, a metallic material and a fibrous material.

Net 64 is coupled to upper support structure 12 and lower support structure 30 using a plurality of fasteners 72. Fasteners 72 may be, but are not limited to being, jack chains. In the exemplary embodiment, fasteners 72 are spaced along upper support structure 101 and lower support structure 30 to secure net 64 to upper support structure 101 and lower support structure 30.

In operation, gearbox 40 is selectively activated, thereby rotating drive shaft 14. Rotational force from shaft 14 causes grooved winch drums 46 and grooved winch drums 48 to rotate in a first direction 74. As grooved winch drums 46 rotate, cables 60 and cables 62 are wound around grooved winch drums 46, thereby elevating lower support structure 30 and net lower edge 71 towards upper support structure 101. As net lower edge 71 and lower support structure 30 transition towards upper support structure 101, net 64 is folded in an accordion like manner. In the exemplary embodiment, gearbox 40 remains activated until lower support structure 30 contacts a switch 76, i.e. when lower support structure 30 is proximate to and approximately parallel with upper support structure 101 as shown in FIG.

4. In an alternative embodiment, gearbox 40 remains activated until a user selectively de-energizes power to gearbox 40.

To lower sports enclosure 100, gearbox 40 is energized to cause grooved winch drums 46 to rotate in a second direction 78 that is opposite first direction 74. Cables 60 and cable 62 are wound around grooved winch drums 46 causing lower support structure 30 to transition away from upper support structure 101. As lower support structure 30 and upper support structure 101 are separated, net 64 is unfolded until net 64 is suspended substantially unfolded between upper and lower support structures 101 and 30, respectively. In the exemplary embodiment, gearbox 40 remains activated until a switch 80 is activated, i.e. when lower support structure 30 is proximate to and approximately parallel to a floor surface.

Figure 6:
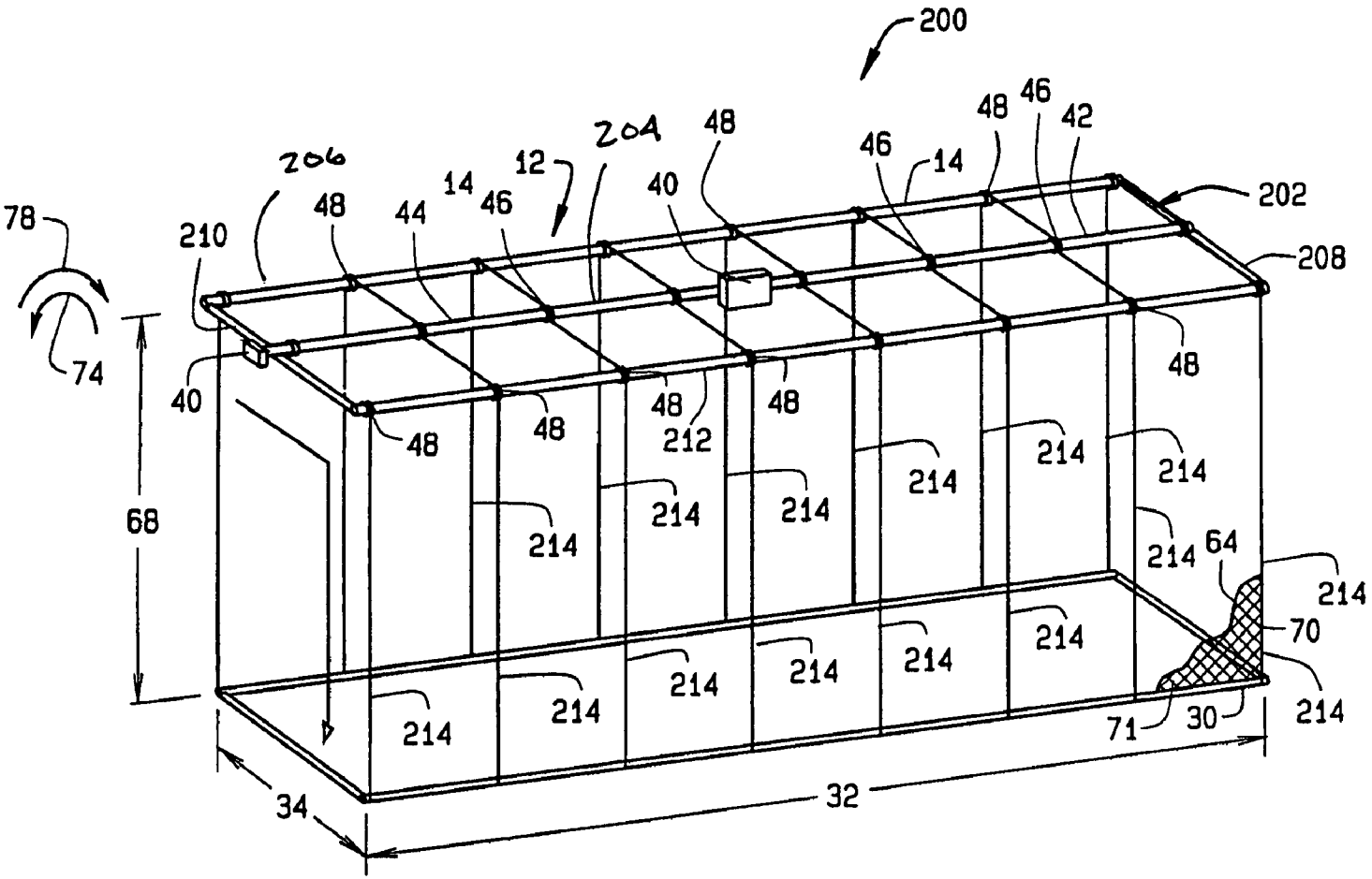
FIG. 6 is a perspective view of an exemplary enclosure assembly.

FIG. 6 is a perspective view of an exemplary enclosure assembly 200. Enclosure assembly 200 is substantially similar to enclosure assembly 10, (shown in FIGS. 1-4) and components in enclosure system 200 that are identical to components of enclosure system 10 are identified in FIG. 6 using the same reference numerals used in FIGS. 1-4.

In the exemplary embodiment, enclosure assembly 200 includes an upper support structure 202 including a primary drive shaft 204, a first coupling shaft 206, a second coupling shaft 208, a third coupling shaft 210, and a fourth coupling shaft 212. In the exemplary embodiment, shafts 206, 208, 210, and 212 are coupled together to form a substantially rectangular assembly.

In the exemplary embodiment, enclosure assembly 200 also includes a lower support structure 30. Lower support structure 30 has a length 32 and a width 34 that are approximately equal to a respective length 36 and width 38 of upper support structure 202. In one embodiment, length 32 and length 36 are each approximately seventy feet, and width 34 and width 38 are each approximately fifteen feet. It should be realized that the size of enclosure assembly 200 is varied depending upon the application of assembly 200, and as such, the size of assembly 200 can be modified without affecting the novelty of the invention described herein. Upper support structure 202 and lower support structure 30 are fabricated from a material such as, but not limited to, an aluminum alloy or steel.

Enclosure assembly 200 also includes at least one gearbox 40 that is coupled to a drive shaft 204. In one embodiment, gearbox 40 is a motor driven gearbox. In another embodiment, gearbox 40 is a manually driven gearbox. In one embodiment, gearbox 40 is coupled between a driveshaft first portion 42 and a driveshaft second portion 44. In another embodiment, drive shaft 204 is unitary and gearbox 40 is coupled to an end 45 of drive shaft 204.

Enclosure assembly 200 also includes a plurality of grooved winch drums 46 coupled to drive shaft 204, and a plurality of grooved winch drums 48 that are rotatably coupled to first coupling shaft 206 and fourth coupling shaft 212. More specifically, a plurality of cables 214 having an approximately equal length, are coupled to grooved winch drums 46. In the exemplary embodiment, cables 214 extend through grooved winch drums 48, and are coupled to lower support structure 30. In an alternative embodiment, enclosure assembly 200 does not include lower support structure 30, and rather cables 214 are coupled to a net 64. In the exemplary embodiment, cables 214 are interwoven through net 64 and then coupled to lower support structure 30. In another exemplary embodiment, cables 214 are interwoven through net 64 and then coupled to a lower portion 70 or lower edge 71 of net 64. Cables 214 are each fabricated from a material such as, but not limited to, a metallic material and a fibrous material.

In operation, gearbox 40 is selectively activated, thereby rotating drive shaft 204. Rotational force from shaft 204 causes grooved winch drums 46 and grooved winch drums 48 to rotate in a first direction 74. As grooved winch drums 46 rotate, cables 214 are wound around grooved winch drums 46, thereby elevating lower support structure 30 and net lower edge 71 towards upper support structure 202. As net lower edge 71 and lower support structure 30 transition towards upper support structure 202, net 64 is folded in an accordion like manner. In the exemplary embodiment, gearbox 40 remains activated until lower support structure 30 contacts a switch 76, i.e. when lower support structure 30 is proximate to and approximately parallel with upper support structure 202 as shown in FIG. 4. In an alternative embodiment, gearbox 40 remains activated until a user selectively de-energizes power to gearbox 40.

To lower sports enclosure 200, gearbox 40 is energized to cause grooved winch drums 46 to rotate in a second direction 78 that is opposite first direction 74. Cables 214 are unwound from grooved winch drums 46 causing lower support structure 30 to transition away from upper support structure 202. As lower support structure 30 and upper support structure 202 are separated, net 64 is unfolded until net 64 is suspended substantially unfolded between upper and lower support structures 202 and 30, respectively. In the exemplary embodiment, gearbox 40 remains activated until a switch 80 is activated, i.e. when lower support structure 30 is proximate to and approximately parallel to a floor surface.

The sports enclosures described herein are each portable and self-standing. Moreover, each enclosure can be extended open and retracted closed automatically without prefolding the net. When opened, the sports enclosure provides a large enclosed area for sports practice and games. When closed, the enclosure can be stored in an overhead of a sports facility in a fully retracted position. The sports enclosure enables a single user to setup or retract the enclosure using the motor driven gearbox. For example, since the enclosure net is coupled to both the upper support structure and the lower support structure, activating the motor driven gearbox raises the entire enclosure without requiring a user to fold the net over the frame. Accordingly, additional users are not required to retract or setup the enclosure. Further, a plurality of sports enclosures can be coupled together to form a single sports enclosure. For example, at least two sport enclosures can be combined be raising a single side net of each individual sports enclosure. The enclosures can then be coupled to form a single enclosure that includes an area defined by the nets that is approximately twice the area of a single sports enclosure.

Exemplary embodiments of sports enclosures are described above in detail. The sports enclosures are not limited to the specific embodiments described herein, but rather, components of each assembly may be utilized independently and separately from other components described herein. For example, each motor driven gearbox and driving shaft can also be used in combination with other enclosure assembly components described herein.

While the invention has been described in terms of various specific embodiments, those skilled in the art will recognize that the invention can be practiced with modification within the spirit and scope of the claims.

What is claimed is:

1. A sports enclosure assembly comprising:

an upper support structure comprising a rotatable shaft that forms a side of said upper support structure;

a driving gear rotatably coupled to said upper support structure; and a net comprising a lower edge, said net coupled to said upper support structure such that said net and said upper support structure define at least two sides of at least one enclosure having at least three sides, said enclosure sized to receive a user therein, at least one sports enclosure is defined by said net lower edge and said upper support structure, said net lower edge coupled to said rotatable shaft such that said net is foldable between said upper support structure and said net lower edge, such that said net lower edge is adjacent said rotatable shaft when said net is folded.

2. A sports enclosure in accordance with claim 1 further comprising a lower support structure coupled to said net lower edge such that said at least one enclosure is defined by said upper support structure, said lower support structure, and said net.

3. A sports enclosure in accordance with claim 1 further comprising a first rotatable shaft coupled to said driving gear such that operation of said driving gear rotates said first rotatable shaft to selectively raise or lower said net relative to said upper structure.

4. A sports enclosure in accordance with claim 3 further comprising:

a plurality of grooved winch drums coupled to said first rotatable shaft; and a plurality of cables coupled between said grooved winch drums and said net lower edge such that operation of said driving gear selectively raises or lowers said net lower edge relative to said upper support structure.

5. A sports enclosure in accordance with claim 3 further comprising a plurality of cables interweaved into said net.

6. A sports enclosure in accordance with claim 3 further comprising a second rotatable shaft coupled to said driving gear such that operation of said driving gear rotates said first rotatable shaft and said second rotatable shaft to selectively raise or lower said net.

7. A sports enclosure in accordance with claim 6 further comprising a plurality of grooved winch drums coupled to at least one of said first rotatable shaft and said second rotatable shaft.

8. A sports enclosure in accordance with claim 1 further comprising at least one switch configured to deactivate said driving gear.

9. A retractable enclosure sized to receive at least one user therein, said enclosure comprising:

an upper support structure circumscribing at least a portion of said enclosure, and comprising a rotatable shaft that forms a side of said upper support structure;

at least one collapsible net coupled to said rotatable shaft, said net forms at least one side of said enclosure;

at least one cable extending from said upper support structure to a lower edge of said net; and at least one gearbox rotatably coupled to at least a portion of said upper support structure for retracting said net towards said upper support structure via said at least one cable such that said net lower edge is adjacent said rotatable shaft when said net is retracted.

10. An enclosure in accordance with claim 9 further comprising a lower support structure coupled to said net lower edge such that said enclosure is defined by said upper support structure, said lower support structure, and said net.

11. An enclosure in accordance with claim 9 further comprising:

a plurality of grooved winch drums coupled to said at least one gearbox; and a plurality of cables coupled between said plurality of grooved winch drums and said net lower edge such that operation of said at least one gearbox selectively raises or lowers said net lower edge relative to said upper support structure.

12. An enclosure in accordance with claim 11 wherein said plurality of cables are interweaved into said net.

13. An enclosure in accordance with claim 9 wherein said rotatable shaft is coupled to said at least one gearbox, said rotatable shaft selectively rotatable to raise or lower said net relative to said upper structure.

14. An enclosure in accordance with claim 9 further comprising a plurality of rotatable shafts coupled to said at least one gearbox, said plurality of rotatable shafts selectively rotatable to raise or lower said net relative to said upper structure.

* * * * *